United States Patent [19]

Perkins

[11] 4,194,915

[45] Mar. 25, 1980

[54] FOUNDRY MOLD AND CORE WASH ADDITIVES

[75] Inventor: Roderick B. Perkins, West University, Tex.

[73] Assignee: N L Industries, Inc., New York, N.Y.

[21] Appl. No.: 866,514

[22] Filed: Jan. 3, 1978

[51] Int. Cl.[2] ..... B28B 7/38

[52] U.S. Cl. ..... 106/38.25; 106/38.22; 106/236; 106/237; 106/241; 427/134

[58] Field of Search ..... 106/38.22, 38.24, 38.25, 106/38.27, 38.28, 38.5, 236, 237, DIG. 4; 427/134, 135; 260/DIG. 40; 164/33, 72, 14; 264/338

[56] References Cited

U.S. PATENT DOCUMENTS

| | | | |
|---|---|---|---|
| 2,270,770 | 11/1939 | Ray | 106/38.25 |
| 3,027,265 | 3/1962 | Miericke | 106/38.2 |
| 3,403,037 | 9/1968 | Cowan et al. | 106/38.6 |

*Primary Examiner*—Lorenzo B. Hayes
*Assistant Examiner*—W. Thompson
*Attorney, Agent, or Firm*—William E. Johnson, Jr.; Douglas H. May, Jr.

[57] ABSTRACT

Additives useful in producing foundry mold and core washes comprise either: a mixture of 66.75% to 80.05% of an organophilic clay and 19.95% to 33.25% of an alcohol soluble, hexane insoluble thermoplastic resin skin-forming agent; or 7.15% to 15.25% of an organophilic clay, 2.85% to 4.75% of the skin forming agent, and 80% to 90% of a refractory material having a particle size fo 200 mesh or finer.

29 Claims, No Drawings

FOUNDRY MOLD AND CORE WASH ADDITIVES

This invention relates to additives for compounding foundry mold and core washes. In particular, the invention provides an additive comprising a mixture of an organophilic clay and an alcohol soluble, hexane insoluble thermoplastic resin derived from pine wood and optionally containing a refractory material having a particle size of 200 mesh or finer.

Materials which are applied to the interior surfaces of molds are known as mold washes, or mold coatings or sprays. Materials which are applied to the surface of cores are known as core washes, or core coatings of sprays. These washes function to improve the casting surface and reduce the cost of cleaning the casting. When applied to the surface of a mold or core, the additives in the wash fill the voids between the sand grains preventing metal penetration into the mold or core and providing a smooth surface against which the metal can solidify. Additionally, the mold or core wash acts as an insulator between the mold or core and the hot metal thus reducing the temperature to which the mold and core sands are subjected. This prevents the sands from fusing and sticking to the casting thus reducing the cost of cleaning the casting.

Mold and core washes, hereinafter referred to simply as washes, are supplied to a foundry either in dry powder form, ready-to-use consistency, or concentrated slurry form. The dry powder form must be adequately mixed in a suitable liquid carrier or wash extender while the concentrated slurry must be mixed with additional liquid carrier to obtain a ready-to-use consistency. The consistency of the wash depends on the techniques used for applying the wash. Generally, a wash is applied by either spraying, dipping, brushing or swabbing.

Washes contain a wide variety of raw materials. However all washes contain at least one refractory material, a liquid carrier, and a bonding agent. Basic refractory materials used in washes are graphites, coke, mica, silica, alumina, magnesia, asbestos, zircon and combinations of these materials. Carrier liquids are usually chosen from water, alcohols, various naphthas, various chlorinated solvents, or water-alcohol mixtures. The bonding agent or binder insures adherence of the wash film to the surface of a mold or core after drying. Typical water soluble binders include dextrine, goulac, various gums, emulsified oils and resins. Prior art washes are disclosed in the following United States patents and other patents reference therein: U.S. Pat. Nos. 2,618,530; 3,549,392; and 3,770,465.

The effectiveness of prior art washes is dependent on the composition and quality of the molds and cores to which they are applied. Thus there are many proprietary washes on the market and many foundries produce their own washes which are formulated for their particular application.

It is therefore an object of this invention to provide a mold and core wash composition which may be applied to a variety of molds and cores to provide mold and core coatings which are easy to apply, adhere well to the surface of the mold or core, and which result in substantial improvement in the surface quality of the cast metal.

The mold and core was additive of this invention has the broad compositional range as follows:

| | % by weight |
|---|---|
| organophilic clay | 7.15-80.05 |
| skin-forming agent | 2.85-33.25 |
| refractory material | 0-90 |

Washes are prepared from this additive by forming a suspension of the additive is a suitable liquid organic carrier medium such as methanol, ethanol, isopropanol, naphtha, chlorinated solvents, and mixtures thereof. Isopropanol is preferred.

The preferred mold and core wash additives of this invention have the following compositional ranges:

Compostion A:
66.75% to 80.05% organophilic clay
19.95% to 33.25% skin-forming agent
Composition B:
7.15% to 15.25% organophilic clay
2.85% to 4.75% skin-forming agent
80% to 90% refractory material Exemplary organophilic clays for use in the present invention and methods for their preparation are set forth in Hauser U.S. Pat. No. 2,531,427, Jordan U.S. Pat. No. 2,966,506 and Miericke U.S. Pat. No. 3,027,265, the disclosure and teachings of which are specifically incorporated herein by reference. The preferred clay for use in preparing the organophilic clay is selected from the group consisting of hectorite, montmorillonite, and attapulgite. Particularly preferred is attapulgite. It is known that hydrophilic clays may be converted to the organophilic state by admixing the clay with an organic onium compound which has at least one aliphatic radical containing at least 10 carbon atoms, preferably at least 12 carbon atoms. Preferred onium compounds are organic ammonium compounds. Exemplary of such compounds are dimethyldioctadecyl ammonium chloride, dimethylbenzylhydrogenatedtallow ammonium chloride, dimethyldihydrogenatedtallow ammonium chloride, dimethyldodecyloctadecyl ammonium chloride, trimethylbehenyl ammonium chloride, methylbenzyldihydrogentatedtallow ammonium chloride and methyltrihexadecyl ammonium bromide. The preferred onium compound is selected from the group consisting of dimethyldihydrogenatedtallow ammonium chlorde, dimethylbenzylhydrogenatedtallow ammonium chloride and methylbenzyldihydrogenatedtallow ammonium chloride. Particularly preferred is dimethyldihydrogenatedtallow ammonium chloride.

Thus the preferred organophilic clays for use in this invention are dimethyldihydrogenatedtallow ammonium attapulgite, dimethylbenzylhydrogenatedtallow ammonium attapulgite, methylbenzyldihydrogenatedtallow ammonium attapulgite, dimethyldihydrogenatedtallow ammonium hectorite, methylbenzyldihydrogenatedtallow ammonium hectorite, dimethylbenzylhydrogenatedtallow ammonium hectorite, dimethyldihydrogenatedtallow ammonium montmorillonite, dimethylbenzylhydrogenatedtallow ammonium montmonillonite, and methylbenzyldihydrogenatedtallow ammonium montmonillonite. Particularly preferred is dimethyldihydrogenatedtallow ammonium attapulgite.

The skin-forming agent for use in the present invention is an alcohol soluble, hexane insoluble thermoplastic resin derived from pine wood. It is characterized as having a softening point in the range from about 100° C. to about 120° C., and acid number in the range from about 90 to 100, an average molecular weight in the range from 480–510, a hydroxyl content as determined by acetylation in the range from 5% to 6%, a methoxyl content in the range from 4.5% to 5.5%, and an unsaponifiable matter content in the range from 7.0% to 8.5%.

The chemicals extracted from pine wood are separated into three fractions: the liquid terpenes which yield turpentine and pine oil; the aliphatic hydrocarbon-soluble solid fraction which is composed primarily of a mixture of isomers of abietic and pimaric acids; and the aliphatic hydrocarbon-insoluble, alcohol soluble fraction which is a complex mixture of many components including high molecular weight phenols, carboxyl-substituted phenols, substituted phenyl ethers, polyphenols, acidic materials derived from resin acids and oxidized resin acids, polymerized terpenes and natural waxes.

The preferred resin for use as the skin-forming agent of this invention contains 24% phlobaphenes, 11% carboxylated phlobaphenes, 9% substituted stilbenes, 7% lignan hydroxy lactone, 4% flavonoid compounds, 2% lignin-type material, 5% wax, 9% polymerized terpenes, 1% dimethoxystilbene, 17% resin acids, 1% oxidized resin acids and 10% polymerized resin acids. It has a softening point of 110° C.–115° C. as determined by the ASTM ring and ball test, an acid number of 95, an average molecular weight of 495, a hydroxyl content as determined by acetylation of 5.5%, a methoxyl content of 5.1%, and an unsaponifiable matter (ASTM D1065) content of 7.7%.

Exemplary of the refractory materials which may be used in the present invention are graphite, coke, anthracite, lignite coal, silica, zircon (zirconium silicate), olivine, mica, magnesite, alumina, talc, or a combination of these materials. The particle size of the refractory material must be such that it will pass through a 200 mesh screen. The preferred refractory materials are zircon flour, silica flour, alumina, graphite, and mixtures thereof, most particularly, zircon flour, graphite and mixtures thereof.

Mold and core washes are prepared from the additives of the invention by mixing the additive with a suitable liquid organic carrier of the type disclosed, preferably isopropyl alcohol. Preferably the additive is mixed with only enough carrier to make a viscous concentrated slurry until the slurry is homogeneous. The remainder of the carrier is then gradually added to obtain the desired consistency. The consistency required depends on the method of application. In general, low specific gravity solutions are used for spraying (20 to 28 degrees Baume'), medium specific gravity solutions for dipping (25 to 37 degrees Baume'), and heavy specific gravity solutions for brushing (35 to 50 degrees Baume').

When preparing washes utilizing the additive of Composition A, a refractory material of the type disclosed herein must be added to the slurry of the additive and carrier. Thus the wash as used will contain an organophilic clay, a skin-forming agent, a refractory material, and a liquid organic carrier medium. Additional materials can be incorporated into the wash to provide or enhance specific properties of the wash.

The additives of this invention can be prepared by mixing together the organophilic clay, skin-forming agent and refractory material in the concentrations desired and grinding these such that the additive passes through a 200 mesh screen. Alternatively, suitably ground, dry powder organophilic clay, skin-forming agent and refractory material can be mixed together in the concentrations desired to produce a homogeneous blend of these materials.

The following examples will further illustrate the invention and are not intended to limit the invention. Obvious changes may be made by those skilled in the art without changing the essential characteristics of the invention.

In these examples and throughout the specification and claims, all percentages are percentages by weight. Additionally, the apparent viscosity is measured in centipoise and the gel strength is measured in pounds per 100 square feet in accordance with standard API procedures (API RP 13B, Fourth Edition, November, 1972). The skin-forming agent used in the examples is an alcohol soluble, hexane insoluble thermoplastic resin derived from pine wood having a softening point of 110° C.–115° C. as determined by the ASTM ring and ball test, an acid number of 95, an average molecular weight of 495, a hydroxyl content as determined by acetylation of 5.5%, a methoxyl content of 5.1%, and an unsaponifiable matter (ASTM D1065) content of 7.7%. The resin is a complex mixture containing approximately 24% phlobaphenes, 11% carboxylated phlobaphenes, 9% substituted stilbenes, 7% lignan hydroxy lactone, 4% flavanoid compounds, 2% lignin-type material, 5% wax, 9% polymerized terpenes, 1% dimethoxystilbene, 17% resin acids, 1% oxidized resin acids, and 10% polymerized resin acids. The specific product utilized is VINSOL resin, a product of Hercules Incorporated.

EXAMPLE 1

A foundry mold and core wash additive was prepared by blending together 10.5 parts of dimethyldihydrogenatedtallow ammonium attapulgite, 3.8 parts of skin-forming agent, 19 parts of powdered crystalline graphite (80% to 82% carbon), and 66.7 parts of zircon milled to pass through a 200 mesh screen.

A wash containing 52.7% solids was made by mixing together 315 grams of this additive with 178 milliliters of 95% isopropyl alcohol using a laboratory model Multimixer. The suspension was very viscous after mixing for three minutes. An additional 178 milliliters of isopropyl alcohol was added and the mixing continued for seven minutes. The wash was then tested for viscosity and gel strength. The data obtained are given in Table 1.

EXAMPLE 2

A dry blend of the following materials was made: 10.5% dimethyldihydrogenatedtallow ammonium attapulgite, 3.8% skin-forming agent, and 85.7% zircon milled to pass through a 200 mesh screen. A wash was made and tested as in Example 1. The data obtained are given in Table 1.

EXAMPLE 3

A dry blend of the following materials was made: 8.8% dimethyldihydrogenatedtallow ammonium attapulgite, 2.7% skin-forming agent, and 88.5% zircon milled to pass through a 200 mesh screen. A wash was made by mixing together for 15 minutes 339 grams of this additive with 326 milliliters of 95% isopropanol using a laboratory model Multimixer. The wash thus contained 56.7% solids. The wash was tested as in Example 1. The data obtained are given in Table 1.

EXAMPLE 4

A wash additive was prepared by blending together 71.4 parts of dimethyldihydrogenatedtallow ammonium attapulgite and 28.6% skin-forming agent. A wash was prepared by mixing with a laboratory Multimixer 42 grams of this additive with 135 ml. of isopropanol for several minutes. The slurry was then mixed with a laboratory Model F LIGHTNIN mixer while adding an additional 269 milliliters of isopropanol, followed by 60 grams of graphite, 120 grams of zircon milled to pass through a 200 mesh screen, and 120 grams of zircon milled to pass through a 400 mesh screen. After mixing several minutes the wash was tested as in Example 1. The data obtained are given in Table 1. The wash contained 6.3% of the additive and 51.7% total solids.

Table 1

| Wash | Apparent Viscosity | Gel Strength |
|---|---|---|
| Example 1 | 44 | 43 |
| Example 2 | 27.5 | 25 |
| Example 3 | 30 | 26 |
| Example 4 | 47.5 | 27 |

EXAMPLE 5

A blend of 13 parts of dimethyldihydrogentatedtallow ammonium bentonite and 6.5 parts of the skin-forming agent was made. A concentrated wash slurry was then made by mixing together 19.5 parts of this additive with 78 parts of xylene and 2.5 parts of methanol. Thereafter a mold and core wash was prepared by mixing together 20.8 parts of this concentrated slurry with 34 parts of isopropanol and 45.2 parts of zircon flour (milled to pass through a 200 mesh screen). The wash had an apparent viscosity of 25.5 centipoise.

EXAMPLES 6–9

The following wash additives were prepared by blending together the indicated materials:

| Example | Skin-Forming Agent | Dimethyldihydrogenatedtallow Ammonium Attapulgite |
|---|---|---|
| 6 | 26.6% | 73.4% |
| 7 | 21.6% | 78.4% |
| 8 | 31.6% | 68.4% |

EXAMPLES 10–12

The following wash additives were prepared by blending together the indicated materials:

| Example | Dimethyldihydrogenatedtallow Ammonium Attapulgite | Skin-Forming Agent | Zircon Flour (<200 Mesh) |
|---|---|---|---|
| 10 | 8.5% | 3.9% | 87.6% |
| 11 | 10.5% | 3.8% | 85.7% |
| 12 | 12.5% | 3.7% | 83.8% |

Washes were prepared from these additives as in Example 1 and they were evaluated as in Example 1. The data obtained were as follows:

| Example | Apparent Viscosity | Gel Strength |
|---|---|---|
| 10 | 21 | 21 |
| 11 | 27.5 | 25 |

-continued

| Example | Apparent Viscosity | Gel Strength |
|---|---|---|
| 12 | 36.5 | 31 |

EXAMPLES 13–15

The following wash additives were prepared by blending together the indicated materials:

| Example | Dimethyldihydrogenatedtallow Ammonium Attapulgite | Skin-Forming Agent | Zircon Flour (<200 Mesh) | Graphite (<200 Mesh) |
|---|---|---|---|---|
| 13 | 8.5 | 3.9 | 68.2 | 19.4 |
| 14 | 10.5 | 3.8 | 66.7 | 19.0 |
| 15 | 12.5 | 3.7 | 65.2 | 18.6 |

EXAMPLE 16

A mold and core wash was prepared by mixing together with a Cowles Dissolver 1.8 pounds of dimethyldihydrogenatedtallow ammonium attapulgite and 5.4 pounds of isopropanol. To this smooth gel was added an additional 21 pounds of isopropanol, 1.2 pounds of the skin-forming agent, and 30 pounds of zircon flour. This wash had an apparent viscosity of 15.5 centipoise and exhibited some settling of solids upon standing overnight. An additional 0.6 pounds of dimethyldihydrogenatedtallow ammonium attapulgite was added while mixing with the Cowles Dissolver. The wash had a final apparent viscosity of 37.5 centipoise.

EXAMPLE 17

A mold and core wash additive was prepared by mixing together 31.5 parts of dimethyldihydrogenatedtallow ammonium attapulgite, 11.4 parts of the skin-forming agent, and 57.1 parts of graphite. A wash was prepared by mixing together, with a Multimixer for 2 minutes, 30 parts of this additive with 35 parts of 95% isopropyl alcohol. Thereafter an additional 35 parts of the isopropyl alcohol was added and the mixing was continued for 5 minutes. This wash had an apparent viscosity of 19.5 centipoise and a 10 minute gel strength of 18 pounds per 100 square feet. Another wash was prepared by mixing, as before, 35 parts of the additive with a total of 65 parts of the isopropanol. This wash had an apparent viscosity of 35.5 centipoise and a 10 minute gel strength of 26 pounds per 100 square feet.

I claim:

1. A foundry mold and core wash additive comprising from 66.75% to 80.05% of an organophilic clay selected from the group consisting of organophilic hectorite, organophilic montmorillonite, organophilic attapulgite, and mixtures thereof, and from 19.95% to 33.25% of a skin-forming agent, said agent being an alcohol soluble, hexane insoluble thermoplastic resin derived from pine wood.

2. The additive of claim 1 wherein said thermoplastic resin has a softening point in the range from about 100° C. to 120° C., an acid number in the range from about 90 to about 100, an average molecular weight in the range from 480 to 510, a hydroxyl content as determined by acetylation in the range from 5% to 6%, a methoxyl content in the range from 4.5% to 5.5%, and an unsaponifiable matter content in the range from 7.0% to 8.5%.

3. The additive of claim 1 wherein said thermoplastic resin has a softening point in the range from 110° C. to 115° C., an acid number of 95, an average molecular weight of 495, a hydroxyl content as determined by acetylation of 5.5%, a methoxyl content of 5.1%, and an unsaponifiable matter content of 7.7%.

4. The additive of claim 1 wherein said organophilic clay is organophilic attapulgite.

5. The additive of claim 1 wherein said organophilic clay is dimethyldihydrogenatedtallow ammonium attapulgite.

6. The additive of claim 2 wherein said organophilic clay is organophilic attapulgite.

7. The additive of claim 2 wherein said organophilic clay is dimethyldihydrogenatedtallow ammonium attapulgite.

8. The additive of claim 3 wherein said organophilic clay is organophilic attapulgite.

9. The additive of claim 3 wherein said organophilic clay is dimethyldihydrogenatedtallow ammonium attapulgite.

10. A foundry mold and core wash additive comprising from 7.15% to 15.25% of an organophilic clay selected from the group consisting of organophilic hectorite, organophilic montmorillonite, organophilic attapulgite, and mixtures thereof, from 2.85% to 4.75% of a skin-forming agent, said agent being an alcohol soluble, hexane insoluble thermoplastic resin derived from pine wood, and from 80% to 90% of a refractory material having a particle size of 200 mesh or finer.

11. The additive of claim 10 wherein said refractory material is selected from the group consisting of zircon flour, silica flour, chromite flour, olivine flour, ground alumina, graphite and mixtures thereof.

12. The additive of claim 11 wherein said thermoplastic resin has a softening point in the range from about 100° C. to about 120° C., an acid number in the range from about 90 to about 100, an average molecular weight in the range from 480 to 510, a hydroxyl content as determined by acetylation in the range from 5% to 6%, a methoxyl content in the range from 4.5% to 5.5%, and an unsaponifiable matter content in the range from 7.0% to 8.5%.

13. The additive of claim 11 wherein said thermoplastic resin has a softening point in the range from 110° C. to 115° C., an acid number of 95, an average molecular weight of 495, a hydroxyl content as determined by acetylation of 5.5%, a methoxyl content of 5.1%, and an unsaponifiable matter content of 7.7%.

14. The additive of claim 11 wherein said organophilic clay is organophilic attapulgite.

15. The additive of claim 11 wherein said organophilic clay is dimethyldihydrogenatedtallow ammonium attapulgite.

16. The additive of claim 12 wherein said organophilic clay is organophilic attapulgite.

17. The additive of claim 12 wherein said organophilic clay is dimethyldihydrogenatedtallow ammonium attapulgite.

18. The additive of claim 13 wherein said organophilic clay is organophilic attapulgite.

19. The additive of claim 13 wherein said organophilic clay is dimethyldihydrogenatedtallow ammonium attapulgite.

20. The additive of claim 10 wherein said refractory material is selected from the group consisting of zircon flour, crystalline graphite, and mixtures thereof, said organophilic clay is dimethyldihydrogenatedtallow ammonium attapulgite, and said skin-forming agent is a thermoplastic resin having a softening point in the range from 110° C. to 115° C., an acid number of 95, an average molecular weight of 495, a hydroxyl content as determined by acetylation of 5.5%, a methoxyl content of 5.1%, and an unsaponifiable matter content of 7.7%.

21. A foundry mold and core wash additive comprising from 7.15% to 80.05% of an organophilic clay selected from the group consisting of organophilic hectorite, organophilic montmorillonite, organophilic attapulgite, and mixtures thereof, from 2.85% to 33.25% of a skin-forming agent, said agent being an alcohol soluble, hexane insoluble thermoplastic resin derived from pine wood, and from 0-90% of a refractory material having a particle size of 200 mesh or finer.

22. The additive of claim 21 wherein said refractory material is selected from the group consisting of zircon, silica, chromite, alumina, graphite, and mixtures thereof, and wherein said organophilic clay is organophilic attapulgite.

23. The additive of claim 22 wherein said organophilic attapulgite is dimethyldihydrogenatedtallow ammonium attapulgite.

24. The additive of claim 23 wherein said resin has a softening point in the range from 100° C.-120° C., an acid number in the range from about 90 to 100, an average molecular weight in the range from 480 to 510, a hydroxyl content as determined by acetylation in the range from 4.5% to 5.5%, and an unsaponifiable matter content in the range from 7.0% to 8.5%.

25. A foundry mold and core wash comprising a suspension of the additive of claim 1 in an organic solvent.

26. The wash of claim 25 wherein said solvent is isopropanol.

27. A foundry mold and core wash comprising a suspension of the additive of claim 10 in an organic solvent.

28. The wash of claim 27 wherein said solvent is isopropanol.

29. A foundry mold and core wash comprising a suspension of the additive of claim 20 in isopropanol.

* * * * *